US005275243A

United States Patent [19]

Williams et al.

[11] Patent Number: 5,275,243

[45] Date of Patent: * Jan. 4, 1994

[54] DRY POWDER AND LIQUID METHOD AND APPARATUS FOR EXTINGUISHING FIRE

[75] Inventors: Leslie P. Williams; Dwight Williams, both of Vidor, Tex.

[73] Assignee: CCA, Inc., Mauriceville, Tex.

[ * ] Notice: The portion of the term of this patent subsequent to Dec. 1, 2009 has been disclaimed.

[21] Appl. No.: 854,863

[22] Filed: Mar. 19, 1992

Related U.S. Application Data

[63] Continuation-in-part of Ser. No. 672,943, Mar. 21, 1991, Pat. No. 5,167,285.

[51] Int. Cl.[5] ..... A62C 31/07

[52] U.S. Cl. ..... 169/46; 169/14; 169/15; 169/70; 169/77

[58] Field of Search ..... 169/14, 77, 15, 44, 169/46, 47, 70; 239/458

[56] References Cited

U.S. PATENT DOCUMENTS

| | | | |
|---|---|---|---|
| 1,148,763 | 8/1915 | Fagan | 169/44 |
| 2,562,930 | 8/1951 | Mapes | 169/77 X |
| 3,313,353 | 4/1967 | Williamson et al. | 169/47 |
| 4,640,461 | 2/1987 | Williams | 239/317 |
| 5,167,285 | 12/1992 | Williams et al. | 169/14 |

*Primary Examiner*—David M. Mitchell
*Assistant Examiner*—Andrew C. Pike
*Attorney, Agent, or Firm*—Pravel, Hewitt, Kimball & Krieger

[57] ABSTRACT

A method and apparatus for extinguishing fires by simultaneously applying a spray of dry powder and liquid/liquid-foam, including a nozzle for the simultaneous spray of powder and liquid/liquid-foam, wherein the velocity of the powder stream can be adjusted.

10 Claims, 9 Drawing Sheets

LF
C

P
2A
2A
C
92
92
LF
M
LF
L2
B1
L
L1+F
L
B
B2
94
E
F
SUPPLY OF P
SUPPLY OF L
SUPPLY OF F
P
L
L1
L

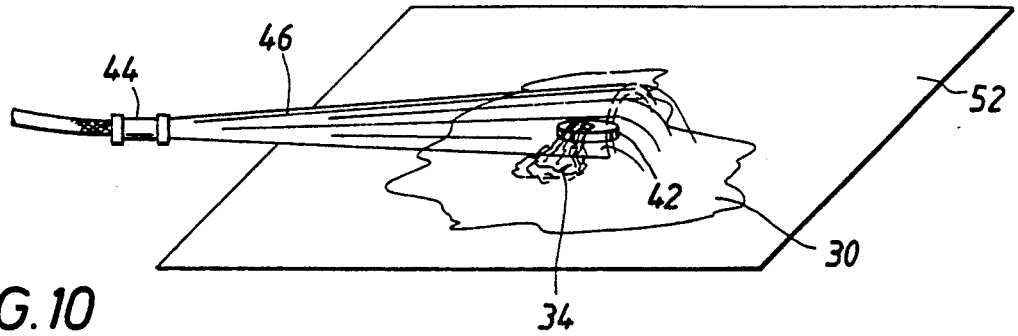
FIG. 10
FIG. 11
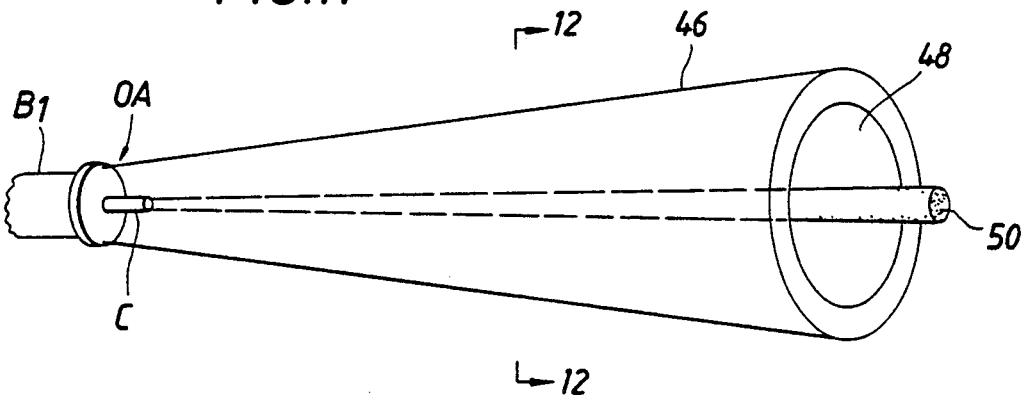
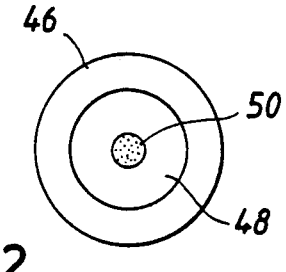
FIG. 12
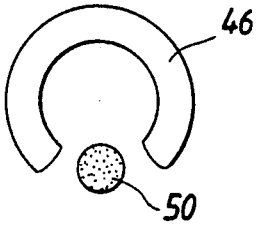
FIG. 13
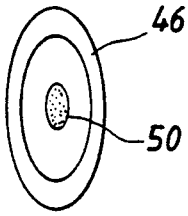
FIG. 14
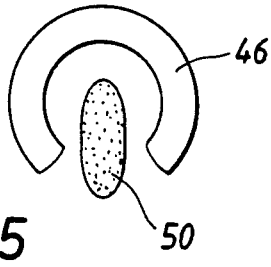
FIG. 15

DRY POWDER AND LIQUID METHOD AND APPARATUS FOR EXTINGUISHING FIRE

This invention is a continuation-in-part of co-pending application Ser. No. 672,943, filed Mar. 21, 1991, now U.S. Pat. No. 5,167,285.

FIELD OF THE INVENTION

This invention relates to method and apparatus for extinguishing fires, and in particular, for extinguishing large industrial conflagrations including three-dimensional fires.

BACKGROUND OF THE INVENTION

The effectiveness of dry powders in extinguishing fires has been known for some time. Sodium bicarbonate, potassium bicarbonate, monophosphate, potassium chloride (Purple K) and potassium salt are some powders that have been used in fire extinction systems. Silicone may be added to the dry powder to aid in the powder's free flow. Even silicone alone has been used effectively as a dry powder to extinguish fires.

A liquid, and more particularly, a liquid foam may be used in conjunction with a dry powder for extinguishing a fire. For the powder to operate effectively in this situation, however, it should be prevented from wetting. Further, if the powder is not well treated with an anti-wetting composition, the powder may break down the foam.

It is known in the art to coat the dry chemicals used as powders to fight fires with silicone or other anti-wetting compositions. It is recommended, in the applications discussed herein, to use "foam compatible" powders as defined by the NFPA. Experience indicates that treated powders can comingle with foam at the site of the fire without inhibiting either product's fire extinguishing properties.

The use of dry powder to extinguish fires has at least two significant disadvantages. Dry powder is difficult to spray for any distance. Thus, the spraying nozzle for dry powder alone must be drawn much closer to the fire than a liquid nozzle. Further, a fire extinguished by powder has a definite propensity to reignite under common circumstances. If a three dimensional fire, in particular, has burned long enough to heat elements in its environment, such as metals, although the dry powder may extinguish the fire, it is likely to reignite when the powder dissipates.

The term two dimensional (or static) fire is used herein to indicate the combustion of a non-replenishing fluid or solid. An example of a two dimensional fire is the burning of a tank or pond that is not, or at least is no longer, being fed from a remote source. The term three dimensional (or dynamic) fire, by distinction, is used to refer to a fire that is fed by a remote replenisbing source. A well blow out and a burning tanker (the burn area being fed by fluid from within) are examples of three dimensional, dynamic fires.

Dry powder is particularly useful in extinguishing a three dimensional fire, subject to the above disadvantages. Liquids and liquid foam mixtures are particularly useful in extinguishing static, two dimensional fires, as well as in cooling and reducing the size of three dimensional fires. It is quite difficult, however, with liquid and liquid foam mixtures alone, to extinguish a three dimensional fire.

The alternating use of powders and liquids on fires has been attempted. The difficulty with this technique is the degree of coordination required and the close approach to the fire required for the powder nozzle.

The present invention discloses a method and apparatus for applying simultaneously dry powder and liquid, including a liquid foam mixture, to a fire. The method and apparatus is particularly useful for the extinction of three dimensional fires, together with their associated static fires. The method and apparatus achieves not only the advantage of permanently extinguishing a three dimensional fire but also the enhanced safety of permitting operation from a greater distance by extending the distance over which dry powder can be effectively sprayed.

The invention further discloses method and apparatus for adjusting the velocity of the powder stream in order to coordinate that velocity with the distance from the fire of the applying mechanism, be it hand held nozzle or monitor. The ability to adjust the velocity of the powder to coordinate with the distance from the fire of the applying mechanism helps to ensure that the powder stream terminates at the fire, rather than shooting through it.

It has been found that use of the present invention has the further advantage that the amount of dry chemical or powder required to extinguish a fire can be reduced drastically, from say 500 pounds to 75 pounds.

SUMMARY OF THE INVENTION

The invention disclosed herein is both a method and an apparatus for extinguishing fires, and in particular, three dimensional fires. The method comprises applying to the fire, simultaneously, a stream of powder surrounded by a stream of liquid. In the preferred embodiment, the liquid includes a foaming composition. Preferably, the foaming composition would be a film-forming foam. In many applications the liquid is comprised predominately of liquid foam.

The word "surrounded" as used herein is not intended to imply "completely surrounded." "Substantially surrounding" the stream of powder by the stream of liquid is effective. Examples of "surrounding" by "substantially surrounding" are covered below.

In the preferred embodiment, the initial flow path of the liquid stream assumes the shape of a hollow cone. The initial flow path of the powder stream lies within the hollow cone. It has been found that by initially so enclosing the powder stream within the liquid stream, the capacity to throw the powder stream is significantly enhanced.

Since the distance of the fireman, or the applying mechanism, from the fire may vary, the invention includes a manner for varying the velocity of the powder stream discharged. If the fireman or applying mechanism can approach the fire fairly close, it is important to have a mechanism that can control the velocity of the powder stream supplied such that the powder stream does not shoot through the fire, or shoot a hole in the fire. The powder stream trajectory should terminate at the fire. A sparger, removably attachable to the powder outlet of the nozzle, provides a mechanism for controlling the velocity of the powder stream.

As mentioned above, chemical powders that are well treated with an antiwetting composition are preferred. In most applications, the preferred liquid is comprised predominantly of liquid foam. One effect of a sparger may be a widening of the trajectory of the powder stream, leading to an apparent comingling of the stream of dry powder with the stream of liquid or liquid foam several feet along their trajectories. Upon arrival at the fire, however, the powder stream will be contained within the liquid foam stream. It has been found that such comingling does not affect the fire extinguishing capacities of either the liquid foam or the well treated dry chemical. It is not known, but suspected, that powder particles may even penetrate foam bubbles in transit, and the conmingling of the powder stream with the liquid foam stream may increase the foaming of the liquid foam in transit.

In the method of the preferred embodiment, a liquid stream is preferably first applied to a three dimensional fire. The stream is initially sprayed in a broad pattern so that it encapsulates the fire, to the extent possible. During this time, associated static fires, such as from pools that may lie at the feet of the dynamic fire, should be extinguished. The liquid stream cools and reduces the dimensions of the three dimensional fire, to perhaps twenty-five percent of its former size. As the dimensions of the three dimensional fire reduce, the breadth of the liquid spray is reduced. The preferred embodiment applies the powder stream to the fire after the fire has been cooled and diminished substantially by the initial liquid stream. When the powder stream is applied, it is dispensed in the hollow cone of the dispensed liquid stream and contained within the liquid stream as the streams terminate at the fire. The powder acts on the cooled and reduced fire that is continuously and simultaneously encapsulated, to the extent possible, by the liquid stream. Dispensing the powder stream within the hollow of a liquid stream not only enables the powder stream to be thrown further, but simultaneously applying the liquid stream helps prevent the re-ignition of the static or dynamic portions of the fire.

The invention discloses a joint liquid and powder nozzle for extinguishing fires. The nozzle comprises a barrel with an axial bore, the bore having an inlet for receiving at least a liquid stream under pressure and an outlet area through which a liquid stream is thrown, or discharged. In the present invention, a powder conduit is connected to the barrel. The conduit has an inlet for receiving powder and an outlet through which the powder is discharged. The conduit is affixed to the barrel in a manner such that the outlet for the powder is located to effect the powder being discharged in a path substantially surrounded by the path of the discharged liquid stream.

In the preferred embodiment, the liquid stream is discharged from the barrel around an obstruction centered within the axial bore. Typically the obstruction takes the form of a plate of smaller diameter than the axial bore. The discharge pattern of the liquid stream in such case assumes that of a hollow cone. It should be understood that the nozzle is typically adjustable, so that the walls of the hollow cone can be adjusted to diverge, converge, or parallel each other.

In one embodiment, the powder conduit is attached to the exterior of the barrel, with a portion carrying the outlet intersecting the liquid stream itself. Alternately, portions of the conduit are mounted within the axial bore itself. Both means suffice to locate the outlet area of the conduit with respect to the outlet area of the barrel such that the stream of powder is discharged substantially surrounded by the disclosed liquid stream.

When a foaming composition is combined with the liquid, as is preferred, either the liquid foam can be supplied to the nozzle already formed, or the nozzle itself can form a means for mixing a foaming composition and the liquid. In the latter case, the nozzle can include an eductor means attached within the axial bore or other means for receiving a foam forming composite. The eductor or other means communicates with a mixing chamber located in the barrel outlet area and that discharges into that area. The eductor has an inlet to receive a portion of the entering liquid stream from the barrel in order to create a reduced pressure chamber. A second inlet of the eductor receives the foam-forming composite. The liquid stream and foam-forming composite are delivered to the mixing chamber wherein the mixture is aerated to form the proper foam and is discharged.

In the preferred embodiment, the barrel of the nozzle is comprised of two parts. A forward portion telescopically slides over a rearward portion. By telescopically sliding the two portions of the barrel over each other, the shape of the outlet area, and thus the shape of the discharged liquid stream, can be varied.

The outlet area for the dry powder stream is supplied with a removable sparger to adjust the velocity of the dry powder stream. With the sparger in place, the velocity of the powder stream is lessened. Preferred dry powders are comprised of chemicals well treated with an anti-wetting composition. For many applications, the liquid discharged is comprised predominantly of liquid foam.

BRIEF DESCRIPTION OF THE DRAWINGS

FIGS. 6 through 10 illustrate the method of this invention as applied to a three dimensional fire.

FIG. 11 illustrates one pattern for the liquid stream and the powder stream.

FIG. 12 is a cross-sectional view of the liquid stream and powder stream as discharged from a nozzle of the present invention.

FIGS. 13 through 15 illustrate other cross-sectional views of simultaneous streams of powder and liquid in accordance with this invention.

DESCRIPTION OF THE PREFERRED EMBODIMENTS

Figure 6:
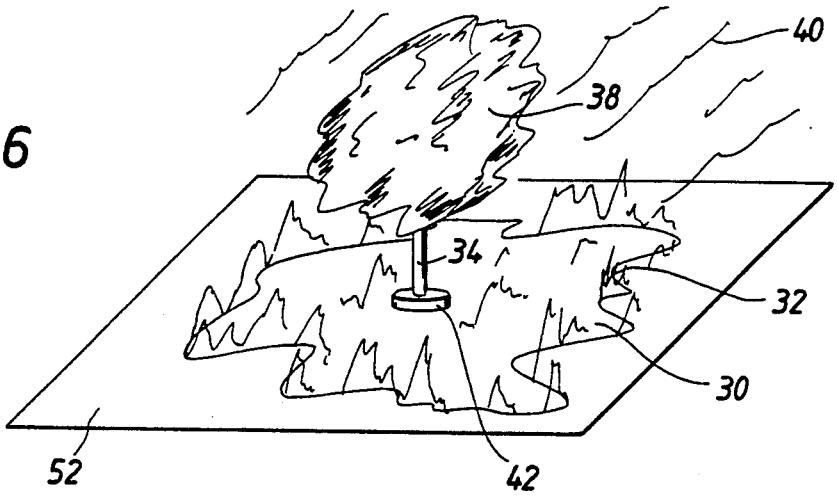
Figure 7:
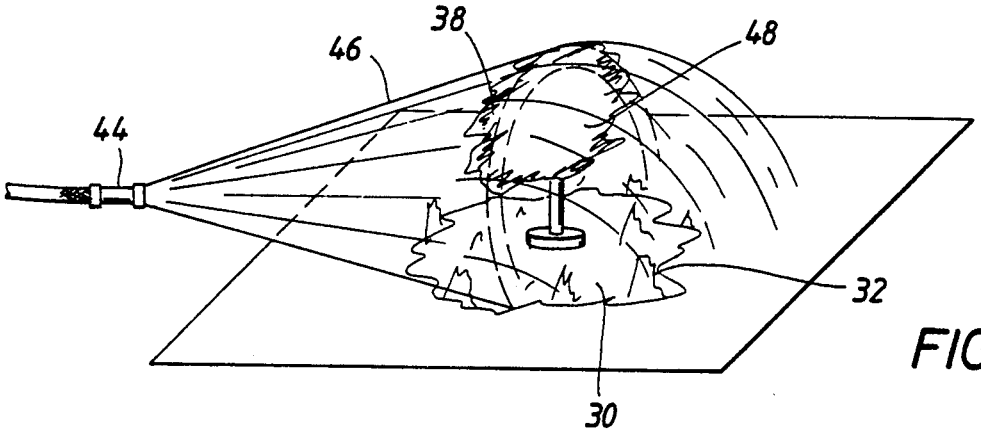
Figure 8:
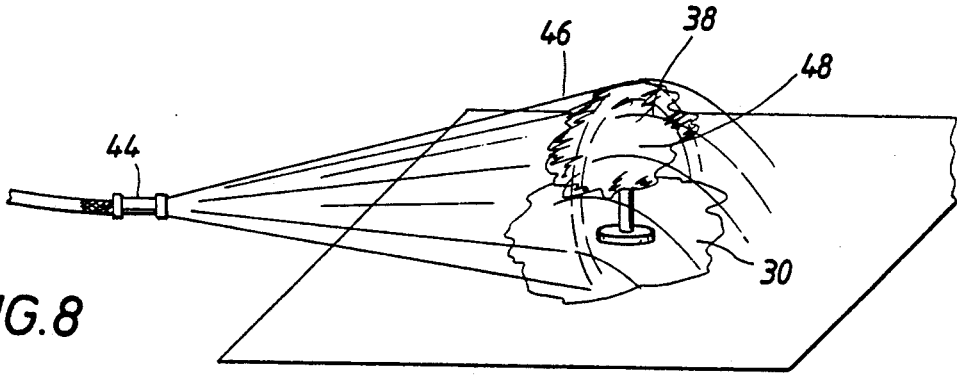
Figure 9:
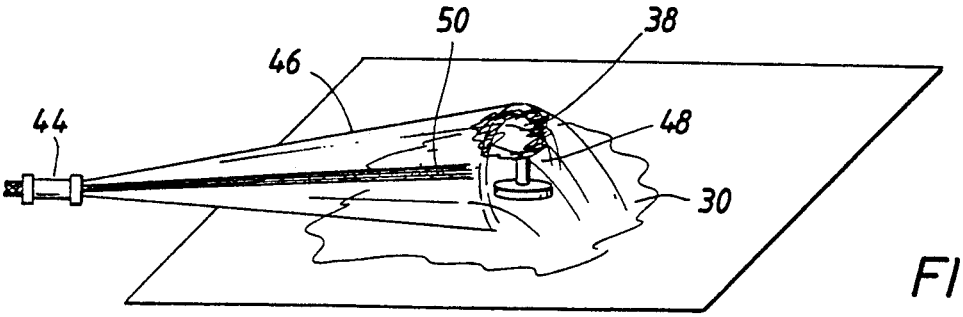

FIGS. 6 through 10 illustrate a preferred embodiment of the method of the present invention. FIG. 6 illustrates a three dimensional fire with an associated static fire. FIG. 6 might be taken to illustrate a well blowout. Combustible fluid 34 is spewing through outlet 42 under pressure from a remote source. The fire or combustion 38 of that fluid rises in the air, generating smoke 40. Pool 30 of the fluid forms on ground 52 and is encompassed by flames 32. In FIG. 7 nozzle 44 is brought to the three dimensional fire. A broad spray 46 of liquid, or preferably liquid with a film forming foam composite, is applied to the fire in a breadth sufficient to encapsulate the fire. The liquid spray is shown applied, in this embodiment, as a hollow cone. FIG. 48 indicates the hollow area of the cone. Upon the application of the liquid spray the static fire 32 of pool 30 diminishes. FIG. 8 illustrates that the spray of liquid foam has extinguished static fire 32 in pool 30 and has diminished the size of the three dimensional fire with combustion area 38. FIG. 8 also illustrates that the breadth of the liquid spray 46 has been reduced as the extent of the three dimensional fire has reduced. Liquid spray 46 is still being thrown in a configuration with a hollow center 48. FIG. 9 illustrates the application of dry powder spray 50, discharging from nozzle 44 through the hollow center of a continuous liquid spray 46. The static fire from pool 30 remains extinguished. The dry powder spray is directed to the diminished combustion portion 38 of the three dimensional fire. FIG. 10 illustrates ground area 52 with the fire extinguished. Liquid spray 46 continues to be applied to pool 30 and surging fluid 34, that now adds to pool 30. However, there is no more combustion, or fire.

FIGS. 1 through 5 illustrate five different embodiments of a nozzle for the simultaneous application of dry powder and liquid/liquid-foam. The nozzle is comprised of barrel B, made up of two portions B1 and B2. B1 telescopically slides over B2 from its left-most and most open position, shown, to its right-most and most closed position, where stop 62 abuts shoulder 64. With B1 in its left-most position, liquid spray LF is discharged in the broadest pattern. With the barrel in its right-most position, liquid spray LF is discharged in its narrowest pattern. Conduit C contains an inlet 66 and outlet area 68. Dry powder is supplied in the inlet and discharged from the outlet. A major portion of conduit C is approximately aligned with the axis of the barrel. In the preferred embodiment the dry powder is supplied to the nozzle under pressure. Liquid L enters the barrel of the nozzle from the left and proceeds generally through the barrel from left to right around structural obstructions. A portion of the Liquid L1 flows through inlet 71 of adductor system E. Adductor system E is located within the center of the axial bore, surrounding conduit C. Liquid L1 that flows through adductor E enters chamber 70. In chamber 70, the reduction in pressure aids to pull foam concentrate F from an external source through conduit 72 and into the adductor chamber. The liquid L1 and foam concentrate F mix and flow through channel 74 surrounding a portion of the powder conduit. The fluid L1 plus the foam F enter mixing chamber M. Additional liquid L2 may enter mixing chamber M through ducts D in obstruction O. The liquid and foam exit mixing chamber M at outlets 80. This liquid and foam mixture mixes with the remainder of the liquid flowing through the outer portion of the axial bore of the barrel. The total liquid and foam mixture is discharged from the outlet area OA of the barrel. The direction of discharge is toward the right in the drawing. Obstruction O associated with mixing chamber M is located in the approximate center of the barrel in the outlet area OA of the barrel. Obstruction O, together with mixing chamber M in the preferred embodiment, cooperate with the barrel such that the liquid foam stream LF discharged from the barrel is discharged in the configuration of a hollow cone.

Figure 1:
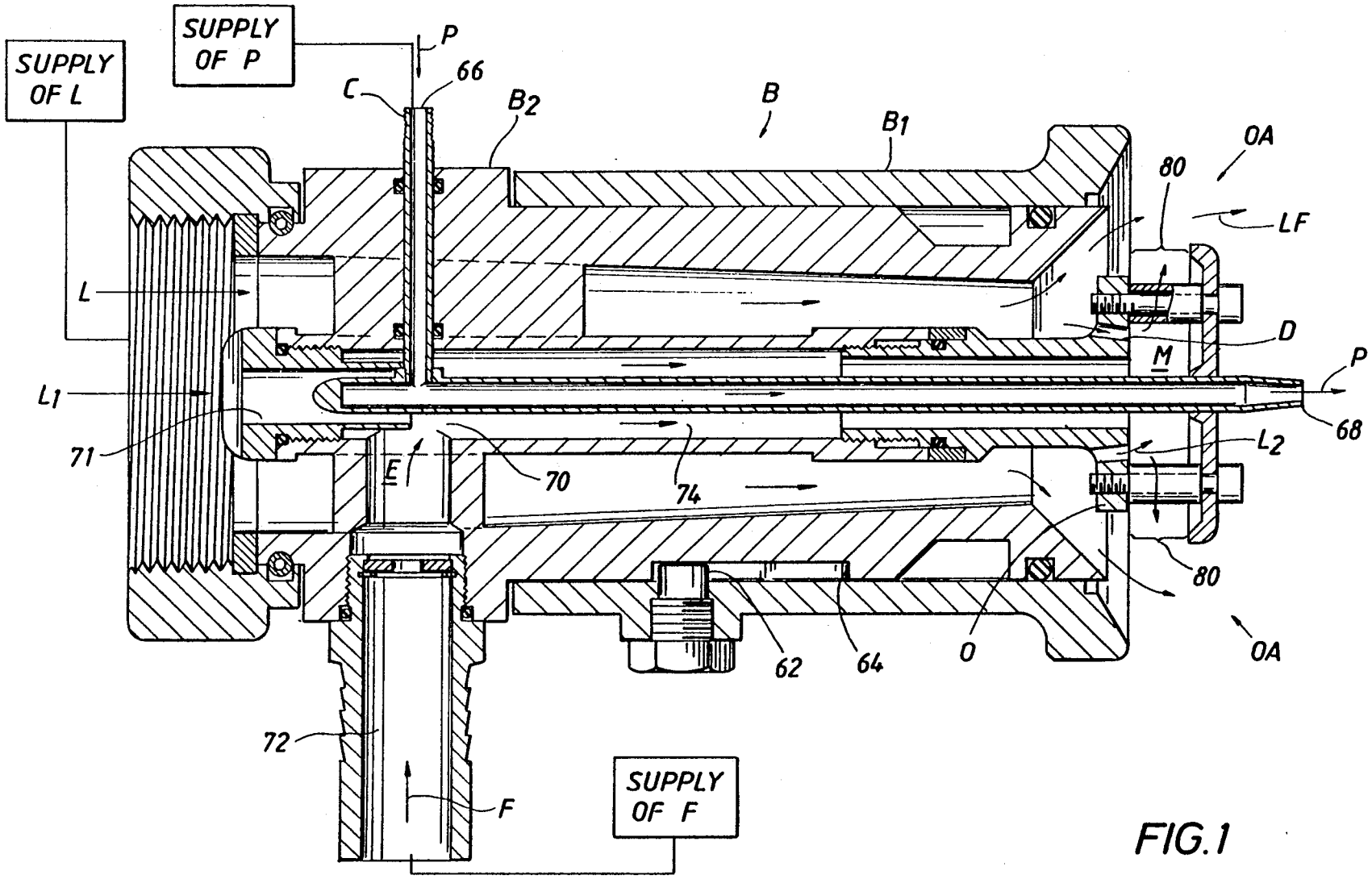
FIG. 1 is a cross-sectional view of one embodiment of the liquid and powder nozzle.
Figures 2, 2A:
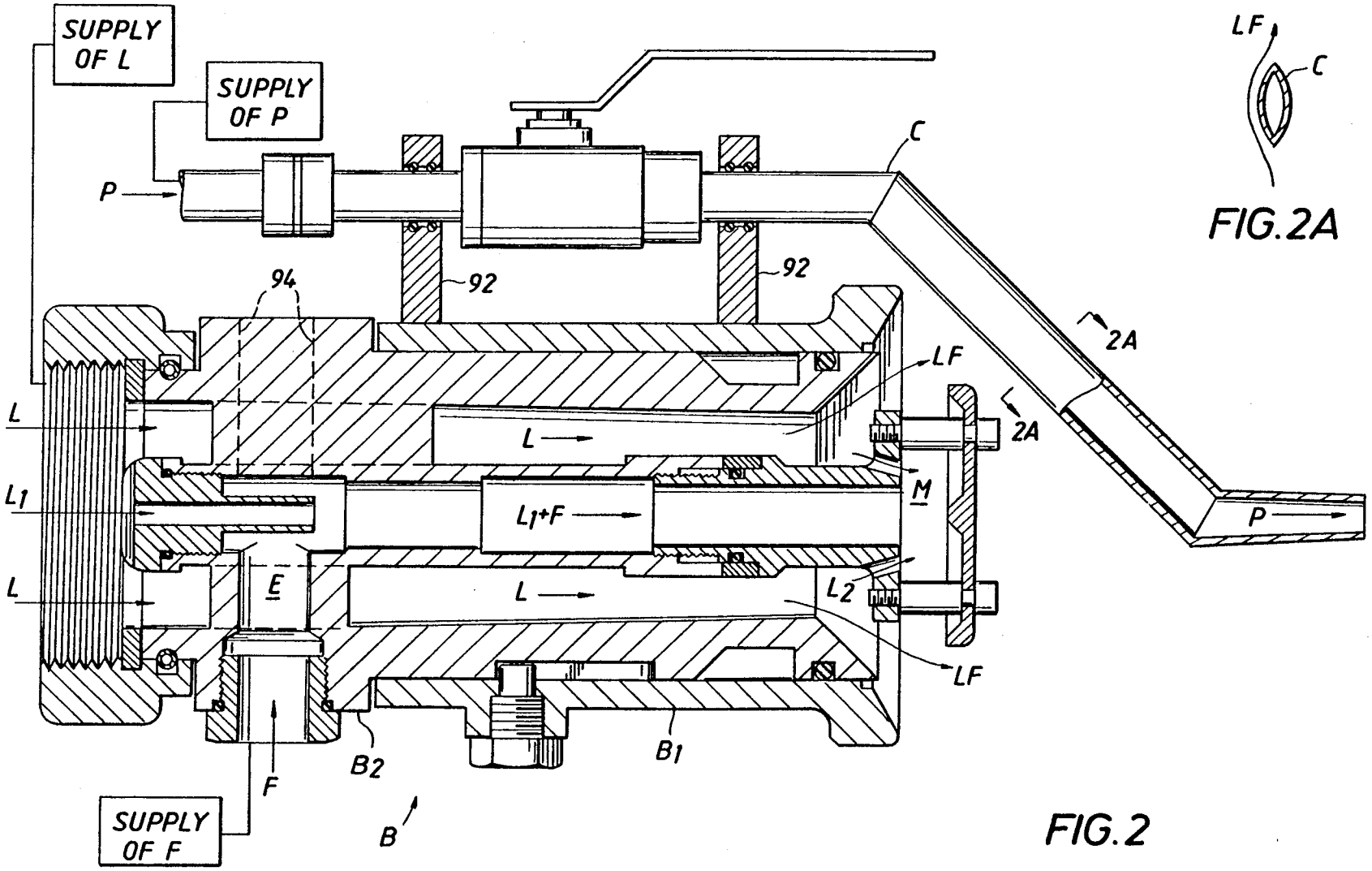
FIG. 2 is a cross-sectional view of a second embodiment of the liquid and powder nozzle.

FIG. 2 is an alternate embodiment of the liquid and powder nozzle. FIG. 2 differs from FIG. 1 predominantly in that the powder conduit C is attached by means 92 to the outside of barrel B. In particular, conduit C is attached to portion B1 of barrel B. Dashed lines 94 indicate in FIG. 2 that foam need not be educted by the adductor through only one conduit. Indeed, foam concentrate F can be educted through multiple conduits or a continuous conduit. FIG. 2A illustrates the preferred design of a portion of conduit C that intersects discharging liquid foam mixture LF. FIG. 2A illustrates that, preferably, conduit C at this portion would have an aerodynamic design such that the liquid foam stream would flow around the conduit in a path of least resistance and least turbulence.

Figure 3:
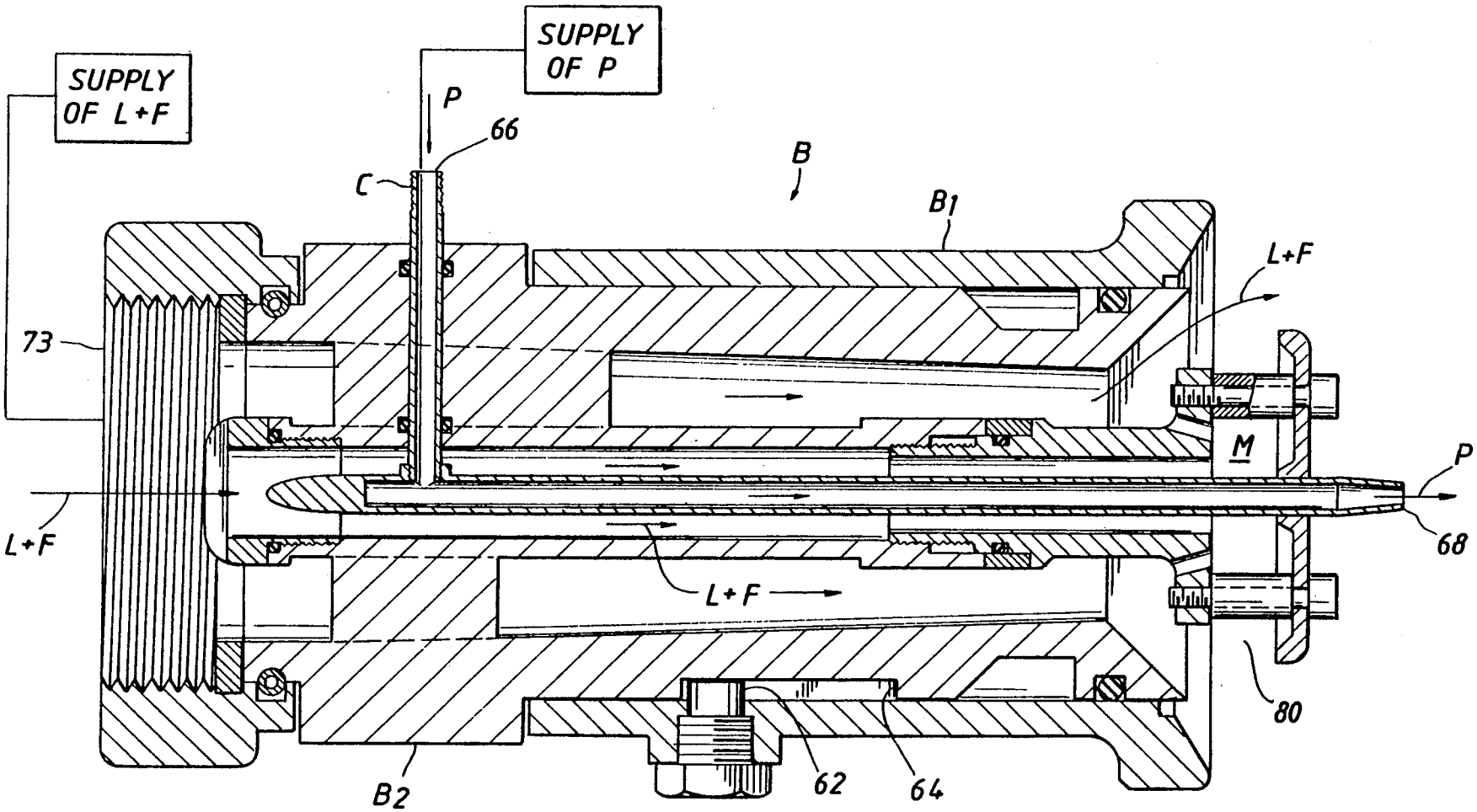
FIG. 3 is a cross-sectional view of a third embodiment of the liquid and powder nozzle.

FIG. 3 illustrates an embodiment of the invention wherein the liquid and foam concentrate F have already been combined before they enter the barrel at inlet 73 on the left of B2. The liquid and foam combination may continue to flow in an inner path through the axial bore to mixing chamber M wherein a portion of the liquid and foam mixture is further aerated before joining the portion of the liquid and foam mixture that passes through the outer areas of the axial bore. In FIG. 3, as in FIG. 1, the powder is supplied to conduit C that contains a portion substantially aligned with the center of the axial bore of the barrel.

Figure 4:
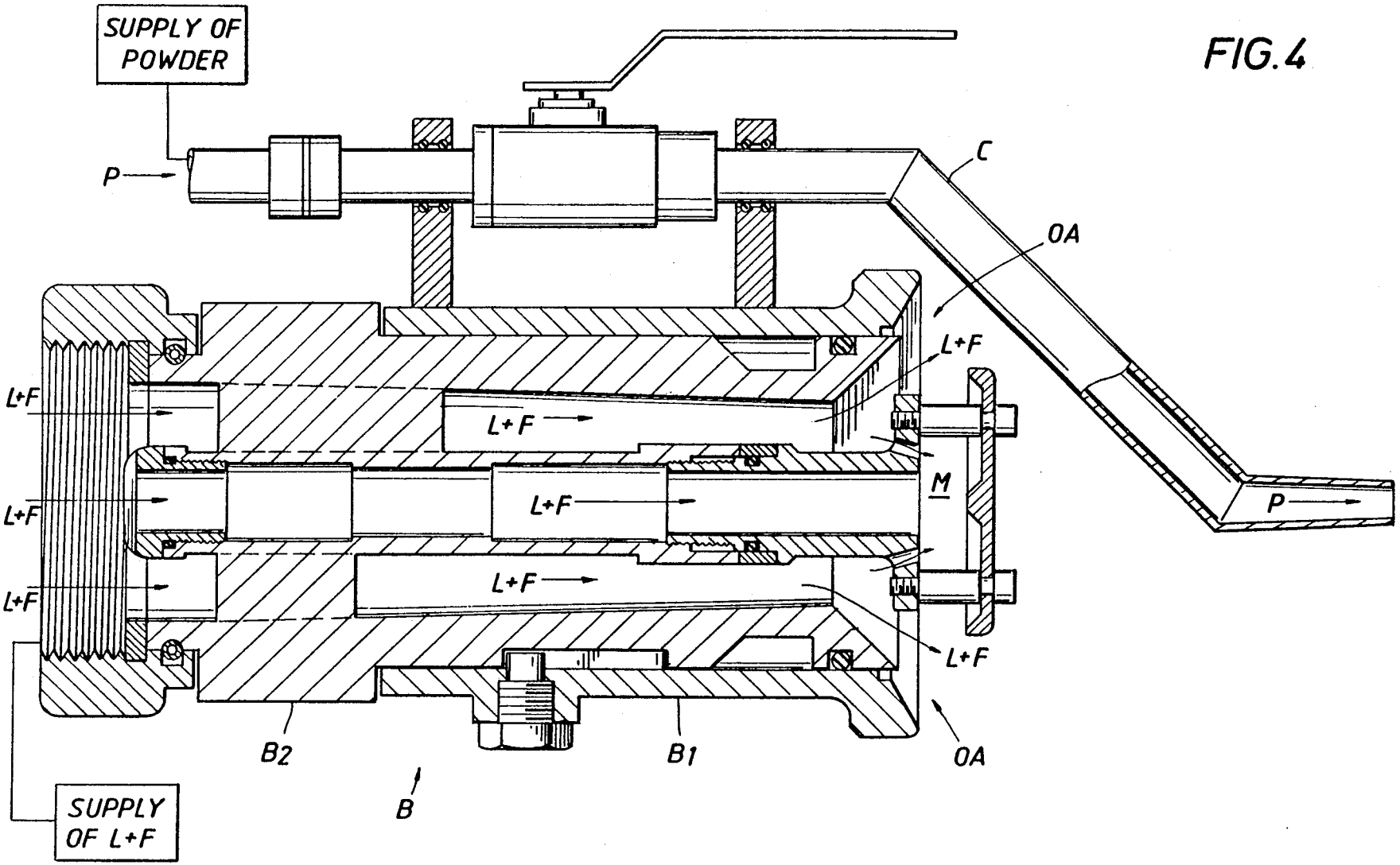
FIG. 4 is a cross-sectional view of a fourth embodiment of the liquid and powder nozzle.

The embodiment of FIG. 4 is like the embodiment of FIG. 3 in that the liquid L and foam concentrate F is supplied to the nozzle already mixed. The embodiment of FIG. 4 is like the embodiment of FIG. 2 in that the powder conduit C is affixed to the exterior of forward barrel B1. Again, since conduit C itself intersects the liquid and foam spray emerging from the outlet area OA of nozzle, preferably conduit C embodies an aerodynamic design at least for the portion in which the conduit intercepts the liquid spray being discharged.

Figure 5:
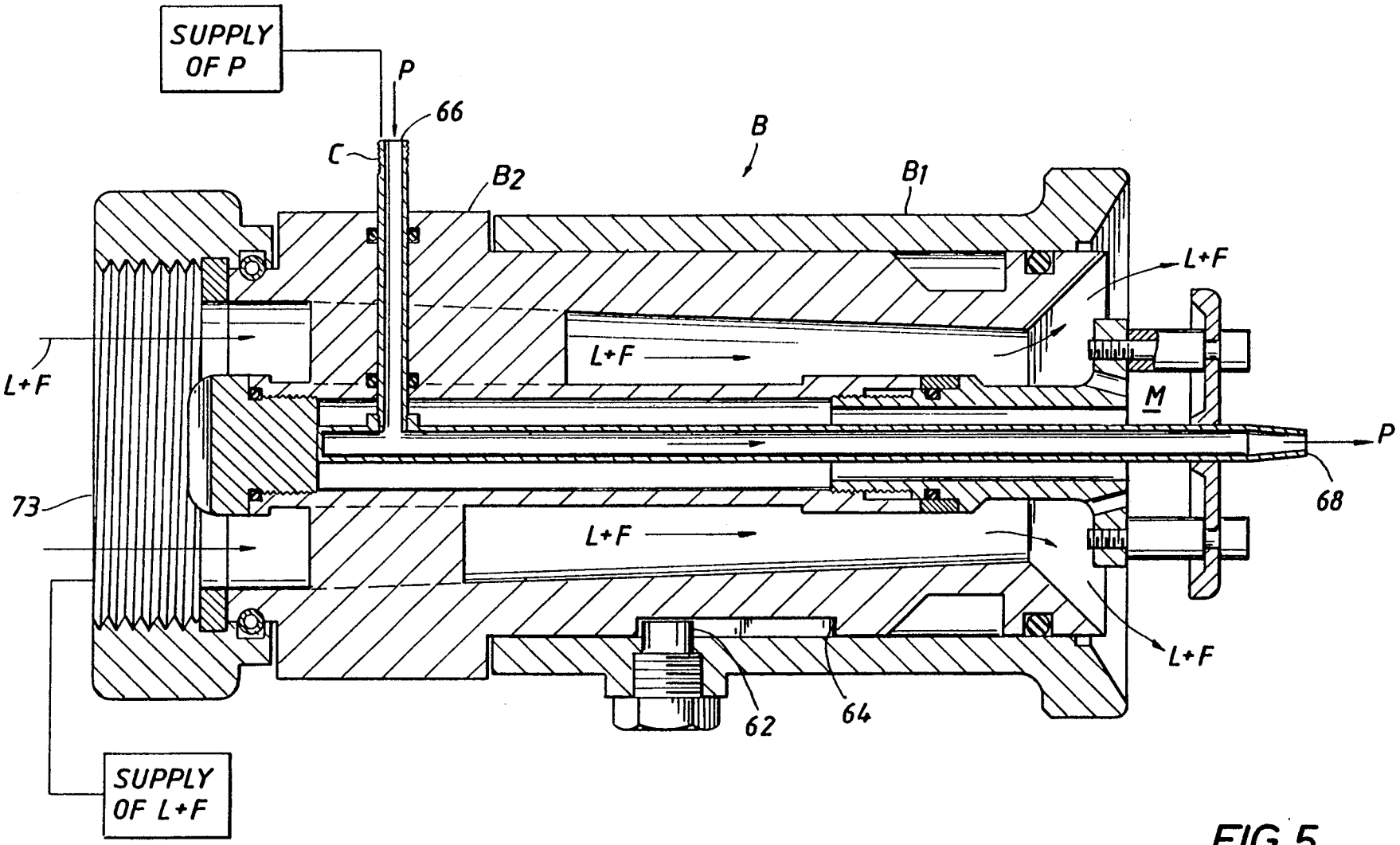
FIG. 5 is a cross-sectional view of a fifth embodiment of the liquid and powder nozzle.

The embodiment of the nozzle illustrated in FIG. 5 is like the embodiment of FIG. 3. That is, the liquid L and foam concentrate F are supplied already mixed to the inlet area 73 to the left on barrel portion B2 in the embodiment of FIG. 5. The liquid and foam, however, do not pass through a central portion surrounding the powder conduit C in the axial bore.

FIG. 11 illustrates a preferred pattern for the simultaneous discharge of powder spray 50 and liquid /liquid-foam spray 46. FIG. 11 illustrates the pattern whereby powder spray 50 is discharged and thrown within the center 48 of a hollow cone comprising the liquid spray 46. FIG. 12 illustrates this configuration in cross-section. FIGS. 13, 14, and 15 illustrate that liquid spray 46 need not absolutely "surround" powder stream 50. As FIG. 13 suggests, liquid spray 46 could be thrown such that its cross-section comprised a part of a ring. Powder stream 50 could occupy space in the ring area not occupied by the liquid stream. FIG. 15 illustrates that the powder stream need not have a circular cross-section but could have an oval cross-section. FIG. 14 illustrates that the liquid stream 46 could have an oval figuration. Since nozzles usually employ circular barrels and circular obstructions, it is anticipated that the easiest hollow liquid/liquid-foam spray to throw would be that of a hollow cone.

Figure 16:
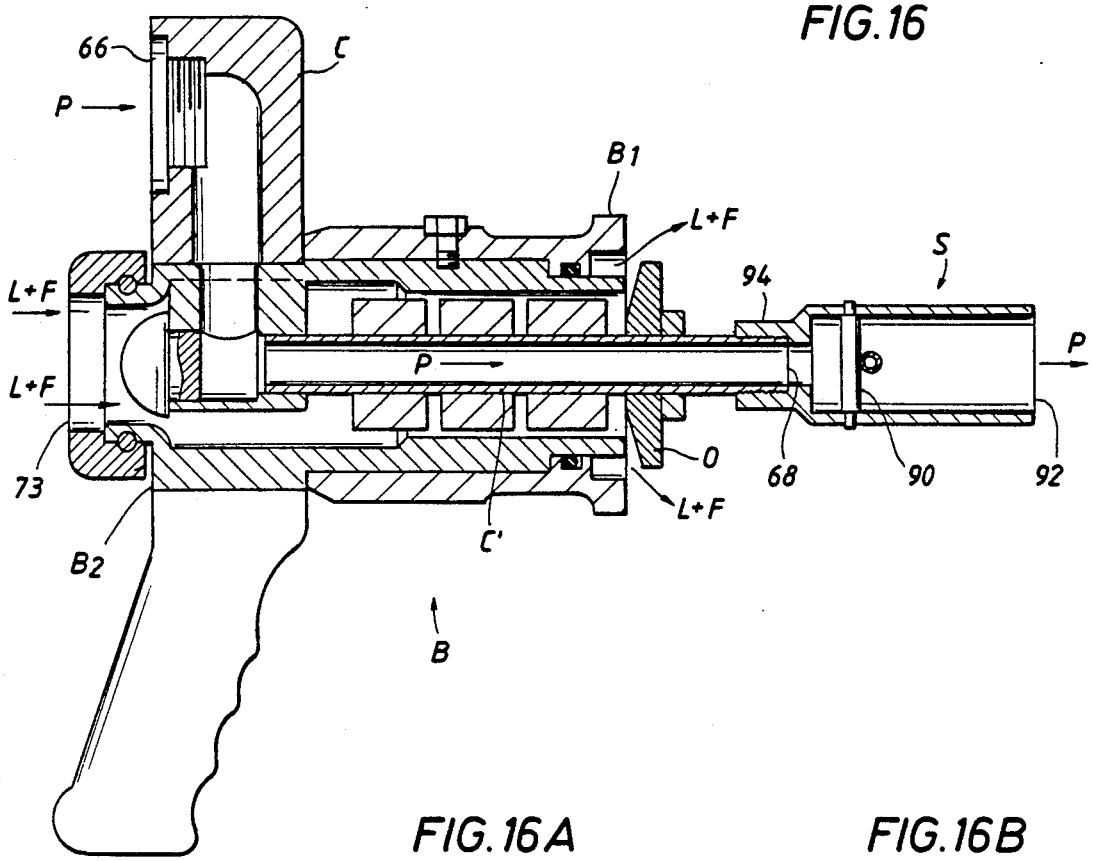
FIG. 16 is a cross-sectional of a nozzle with a sparger attached.

FIG. 16 illustrates a nozzle similar in design to the nozzle of FIG. 5. That is, the liquid L and foam concentrate F enter the nozzle at inlet 73 already comprising a liquid foam. Powder enters the nozzle at inlet 66 through conduit C. The powder passes through conduit portion C', in the central portion of the barrel of the nozzle. However, unlike FIG. 5, sprager S is attached to the outlet area 68 of the powder conduit. FIG. 16 illustrates a simple screw means of attachment whereby sprager S, at end 94, screws onto a pin end of the powder conduit emerging from the center of barrel B. In FIG. 16 obstruction O directs the liquid and foam mixture to flow out an annular opening at the outlet end of barrel B. Sparger S is of greater diameter than the inner powder conduit C, and baffle or diffuser bar 90 is attached to the interior of sparger S. Baffle or diffuser bar 90 slows the velocity of the powder that would otherwise exit from powder conduit outlet 68 if the sparger were not in place.

Figure 16A:
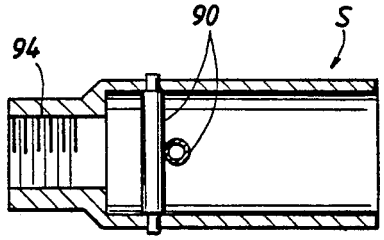
FIGS. 16A and 16C illustrate a cross-sectional view of the sparger of FIG. 16, each with a different embodiment of a diffuser.
Figure 16B:
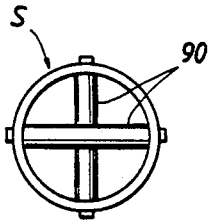
FIGS. 16B and 16D offer a cross-sectional illustration of the diffusers of FIGS. 16A and 16C.
Figure 16C:
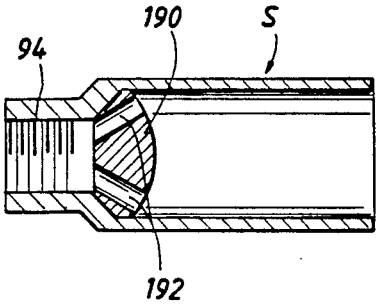
Figure 16D:
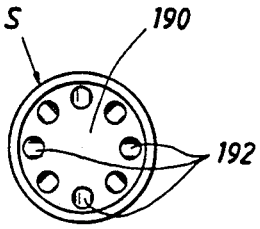

FIG. 16A offers a cross-sectional view of sparger S. FIG. 16B offers a cross-sectional view of diffuser bar 90 within sparger S. From FIG. 16B it can be seen that, in the embodiment illustrated in FIG. 16B, diffuser 90 is comprised of two cross bars retained in the walls of sparger S by roll pins. FIGS. 16C and 16D offer an alternative diffuser plate 190. Diffuser plate 190 is a circular plate with holes therethrough. The purpose of the diffuser plate or bars is to divert and impede powder flow in order to fill the larger diameter of the sparger, reducing the velocity of the powder stream exiting from conduit C'. In diffuser plate 190, the area of holes 192 would roughly equal the area of outlet 68 of conduit C'. The holes would be angled in order to deflect the powder to impact the sides of the sparger.

Figure 19:
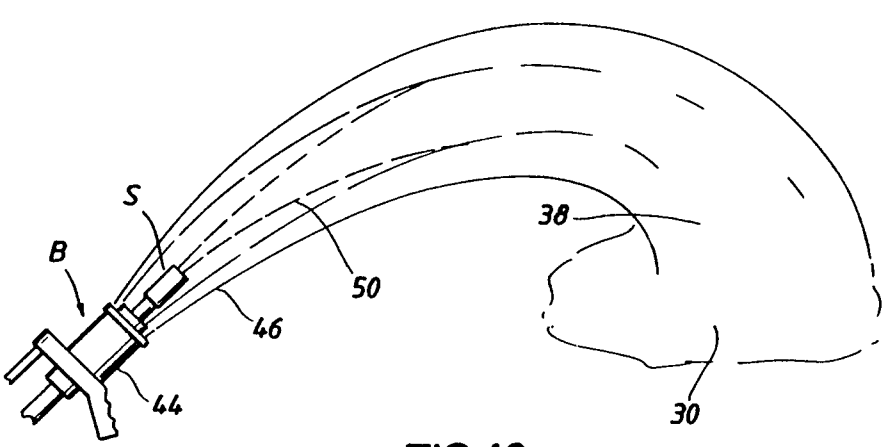
FIG. 19 illustrates a possible trajectory for a powder stream and a liquid stream.

The sparger should be attached to the nozzle if the fire fighter with the nozzle can approach to within possibly twenty to thirty feet of the fire, which is closer than necessary for the longest trajectory of powder P that can be thrown out of outlet 68 inside a liquid or liquid foam stream. One effect of sparger S with diffuser bar 90, at least visually, is illustrated in FIG. 19. With sparger S in place, powder stream 50 appears to comingle with liquid and foam stream 46 after the streams have emerged from the nozzle by several feet. The preferred powder, is a chemical well treated with an anti-wetting composition. Using such powder, even though the streams appear to comingle, the effect of shooting the powder on the fire is the same as if the powder had not comingled with any liquid. The poweder is yet contained within the liquid and foam mixture. It is possible that the chemical powder particles are even carried within bubbles of the foam, and that the powder enhances the continued foaming of the liquid foam mixture through the trajectory. The effect, however, of powder stream 50 upon fire 38 as illustrated in FIG. 19 cannot be distinguished from the effect when the powder stream appears visually to remain essentially uncomingled with the liquid and liquid foam mixture.

Figure 17:
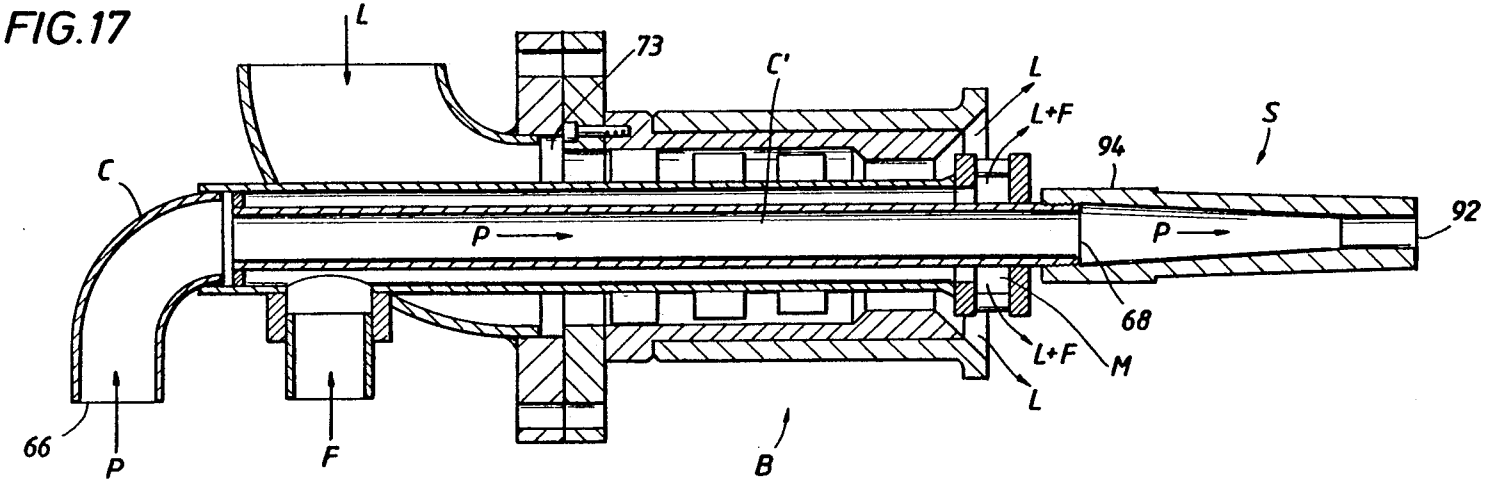
FIG. 17 is a cross-section of an alternate nozzle design with a sparger attached.

FIG. 17 illustrates another preferred embodiment utilizing a sparger S. In FIG. 17 liquid L enters the nozzle through annular opening 73. Powder enters the nozzle through opening 66 and continues through an axial bore C' in the nozzle. Sparger S is attached to powder outlet 68, again, as illustrated, by screwing end 94 of sparger S on to the outlet end of the powder conduit. Sparger S in the embodiment of FIG. 17 contains a bore whose diameter narrows from the attaching end 94 to its outlet area 92. The effect of sparger S is to diminish the velocity of powder exiting outlet area 92, as compared with the velocity that the powder stream would exit from outlet area 68 without the sparger. FIG. 17 illustrates foam concentrate F entering an annular central passageway around powder conduit C1 mixing with liquid in mixing chamber M and being discharged from barrel B of the nozzle through an annular outlet area of the barrel. The trajectory of the powder stream exiting from the nozzle of FIG. 17 may be as illustrated in FIG. 19.

Figure 18:
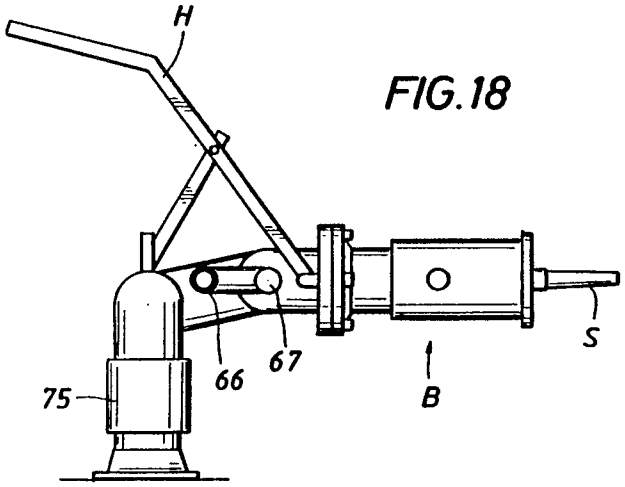
FIG. 18 is a plan view of a monitor carrying a nozzle of the design of FIG. 17.

FIG. 18 illustrates a monitor for the nozzle of FIG. 17 wherein barrel B is attached to a source of liquid 75. Barrel B can be aimed by manipulation of handle H. Inlet 66 illustrates the powder inlet and inlet 67 illustrates the foam inlet. Sparger S is shown attached to the end of barrel B.

Having described the invention above, various modifications of the techniques, procedures, material and equipment will be apparent to those in the art. It is intended that all such variations within the scope and spirit of the appended claims be embraced thereby.

What is claimed is:

1. A liquid and powder method for the extinction of fires, comprising discharging from a mechanism to a fire simultaneously a stream of powder surrounded by a stream of liquid; and adjusting the velocity of the stream of powder to coordinate with the distance of the discharging mechanism from the fire so that the powder stream terminates at the fire while contained within the liquid stream.

2. The method of claim 1, wherein the liquid is comprised predominantly of a liquid foam.

3. The method of claim 2, wherein the liquid foam comprises a film forming foam.

4. The method of claim 1, wherein the powder comprises a chemical well treated with an anti-wetting composition.

5. A liquid and powder nozzle for fire extinction, comprising a barrel having an axial bore with an inlet portion for receiving a liquid stream under pressure and an outlet area through which a liquid stream is discharged;

a powder conduit attached to the barrel, having an inlet for receiving powder and an outlet area through which the powder is discharged;

means for locating the outlet area of the conduit within the outlet area of the barrel for discharging the powder in a path substantially surrounded by the path of the discharged liquid stream; and a sparger that is removably attached to the outlet area of the powder conduit.

6. The nozzle of claim 5 wherein the discharged liquid stream is comprised predominantly of liquid foam.

7. The nozzle of claim 6, wherein the barrel has a foam concentrate inlet portion for receiving a foam concentrate and a mixing chamber for mixing liquid foam.

8. The nozzle of claim 5, wherein the barrel is comprised of a forward portion that telescopically slides over a rearward portion such that the shape of the barrel outlet area can be varied.

9. The nozzle of claim 5, wherein the sparger includes a diffuser bar.

10. A liquid and powder nozzle for fire extinction, comprising:

a barrel having an axial bore with an inlet portion for receiving a liquid stream under pressure and an outlet area through which a liquid stream is discharged;

a powder conduit attached to the barrel, having an inlet for receiving powder and an outlet area through which the powder is discharged;

a sparger attached to the outlet area of the conduit, having a sparger outlet area;

means for locating the outlet area of the sparger within the outlet area of the barrel such that the powder is discharged in a path substantially surrounded by the path of the discharged liquid stream.

* * * * *